US006767234B1

(12) United States Patent
Rosa et al.

(10) Patent No.: US 6,767,234 B1
(45) Date of Patent: Jul. 27, 2004

(54) HOOK AND HANG DISPLAY SYSTEM WITH PLUG-IN BULLNOSE HEADER MODULE

(75) Inventors: Vincent Rosa, New York City, NY (US); Seth Yablans, Brookville, NY (US); Chico Basdeo, New York, NY (US)

(73) Assignee: P.O.P. Displays, Inc., Woodside, NY (US)

( * ) Notice: Subject to any disclaimer, the term of this patent is extended or adjusted under 35 U.S.C. 154(b) by 0 days.

(21) Appl. No.: 10/081,041

(22) Filed: Feb. 14, 2002

(Under 37 CFR 1.47)

Related U.S. Application Data

(60) Provisional application No. 60/268,511, filed on Feb. 14, 2001.

(51) Int. Cl.[7] ..... H01R 13/62

(52) U.S. Cl. ..... 439/327; 248/220.31; 248/222.11; 211/69.6; 211/69.5; 211/18; 211/4; 211/7; 211/1.55; 211/169; 312/136

(58) Field of Search ..... 439/327, 372; 248/94.5, 220.31, 222.11, 220.22; 211/69.6, 69.5, 18, 4, 7, 1.55, 169, 69.7, 168, 131, 71, 94.5, 69.9, 59.1; 312/136

(56) References Cited

U.S. PATENT DOCUMENTS

| | | | | | |
|---|---|---|---|---|---|
| 3,760,952 | A | * | 9/1973 | White | 211/168 |
| 4,606,466 | A | * | 8/1986 | Fredrickson | 211/59.1 |
| 5,255,801 | A | * | 10/1993 | Berger | 211/131.1 |
| 5,588,537 | A | * | 12/1996 | Hagopian | 211/4 |
| 5,662,375 | A | * | 9/1997 | Adams et al. | 296/214 |
| 6,003,685 | A | * | 12/1999 | Malin | 211/7 |

* cited by examiner

*Primary Examiner*—Dean A. Reichard
*Assistant Examiner*—Anton Harris
(74) *Attorney, Agent, or Firm*—Nolte, Nolte & Hunter

(57) ABSTRACT

A display system of having plug-in extended display hooks for hanging products of various widths. A plug-in header module has a bullnose shaped display window for product descriptions and pricing, and extends frontward to the end of the hooks.

5 Claims, 10 Drawing Sheets

227
221

200
227
221
228
222

227
228

221
B
B
200
222

227
228

200

(4:1)

(4:1)

HOOK AND HANG DISPLAY SYSTEM WITH PLUG-IN BULLNOSE HEADER MODULE

CROSS-REFERENCE TO RELATED APPLICATIONS

This application claims priority under 35 U.S.C. 119(e) from provisional application No. 60/268,511 filed Feb. 14, 2001.

BACKGROUND OF THE INVENTION (1) Field of the Invention

The present invention relates to a display system having long display hooks extending from a surface and to an associated product information display.

(2) Description of Related Art Including Information Disclosing Under 37 CFR 1.97 and CFR 1.98

The merchandise display art generally uses pegboard to mount extended hooks for hanging packages of varying sizes. Pegboard has a mundane and conventional appearance. The Mounting of associated product and price information is problematical because the hooks extend far out from the mounting surface and obscure it from most viewing angles.

BRIEF SUMMARY OF THE INVENTION

The present invention is a display system having plug-in extended display hooks for hanging products of various widths. A plug-in header module has a bullnose shaped display window for product descriptions and pricing, and extends frontward to the end of the hooks. The system is more flexible in horizontal spacing, more attractive in appearance, and provides a more prominent display of the product information headers. The headers and hooks are more secure than conventional pegboard.

DETAILED DESCRIPTION OF THE INVENTION

Figure 1:
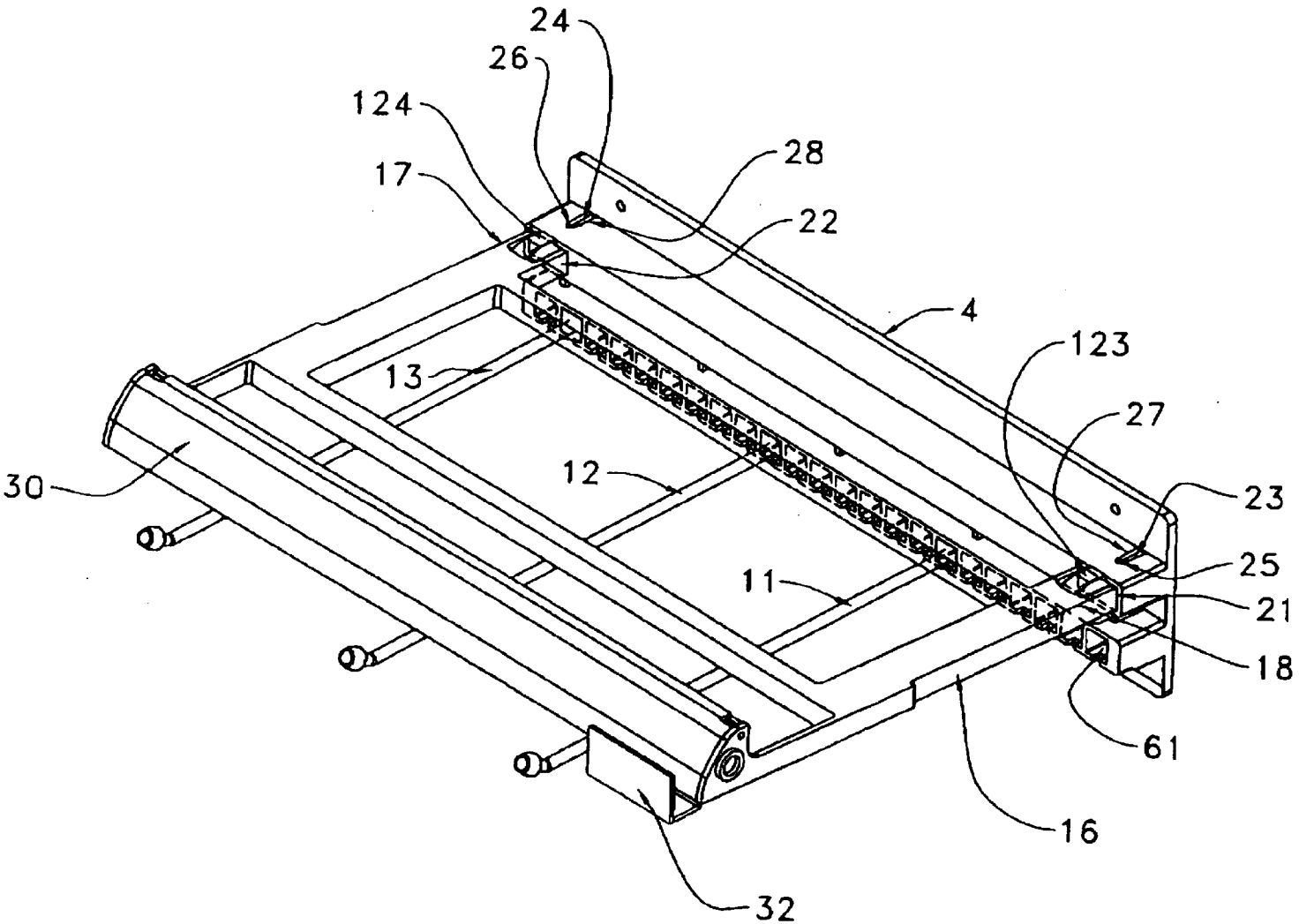
FIG. 1 is a three-dimensional orthogonal view of the system of the present invention.

FIG. 1 shows a preferred embodiment of the display hook system of the present invention, generally designated 2. The system comprises a back 4, to which other elements are mounted. Three extended hooks 11, 12 and 13 extend from back 4, but there are twenty-two holes for accepting various numbers of such hooks in various spacings that may be appropriate to accommodate various package widths.

Header module 16 comprises a pair of plugs 17 and 18 which fit into sockets 21 and 22. Snap tabs 23 and 24 are spring biased to snap into frame sockets 21 and 22. As in FIG. 2, tabs 23–24 have pins 25-6 which spring up into slots 27 and 28 which receive pins 25-6 and lock header module 16 in place on back 4. A bullnosed shaped header 30 is provided to provide product information and a secondary header 32 may protrude therefrom.

Figure 3:
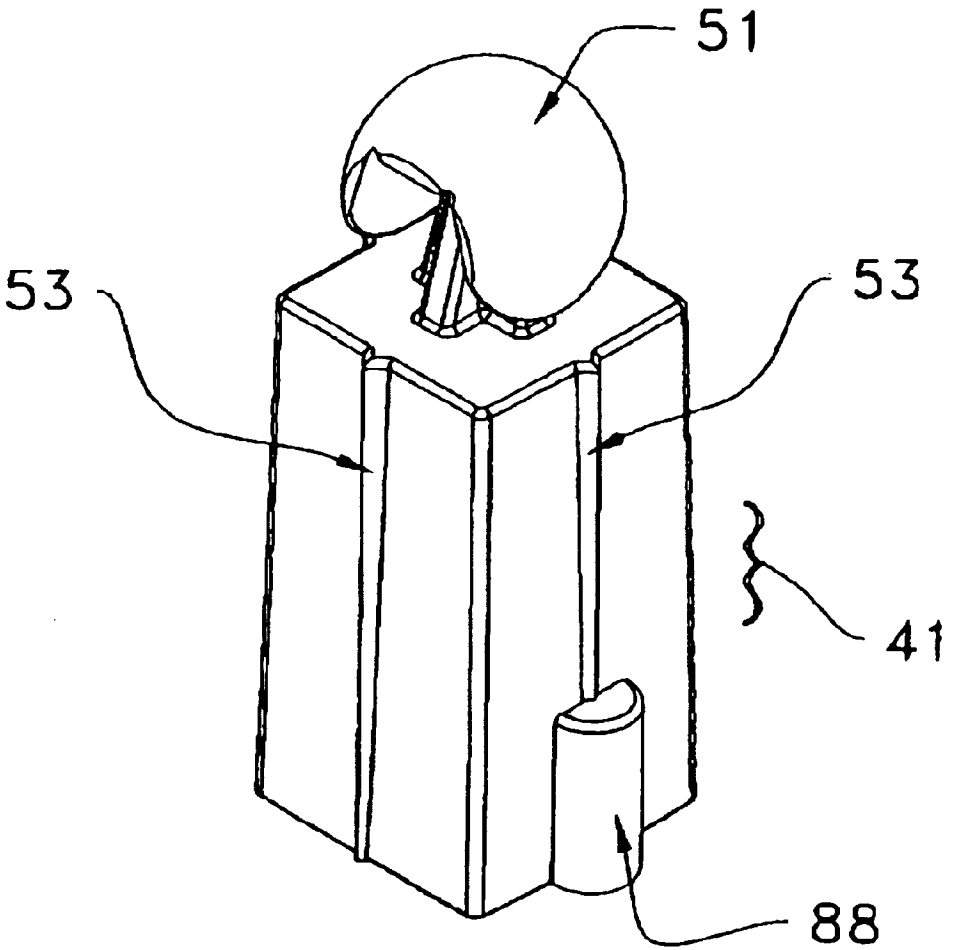
FIG. 3. is an oblique three-dimensional orthogonal view of a snap mount for mounting the hook on the assembly.

Hooks 11, 12 and 13 are preferably molded, or may be press fit, onto hook snaps 41–43. Hook snaps 41–43 snap by means of a ball such as 51 shown in FIG. 3 into a plurality of hook sockets 61–84 designed to receive said hooks snaps 41–43.

Figure 2:
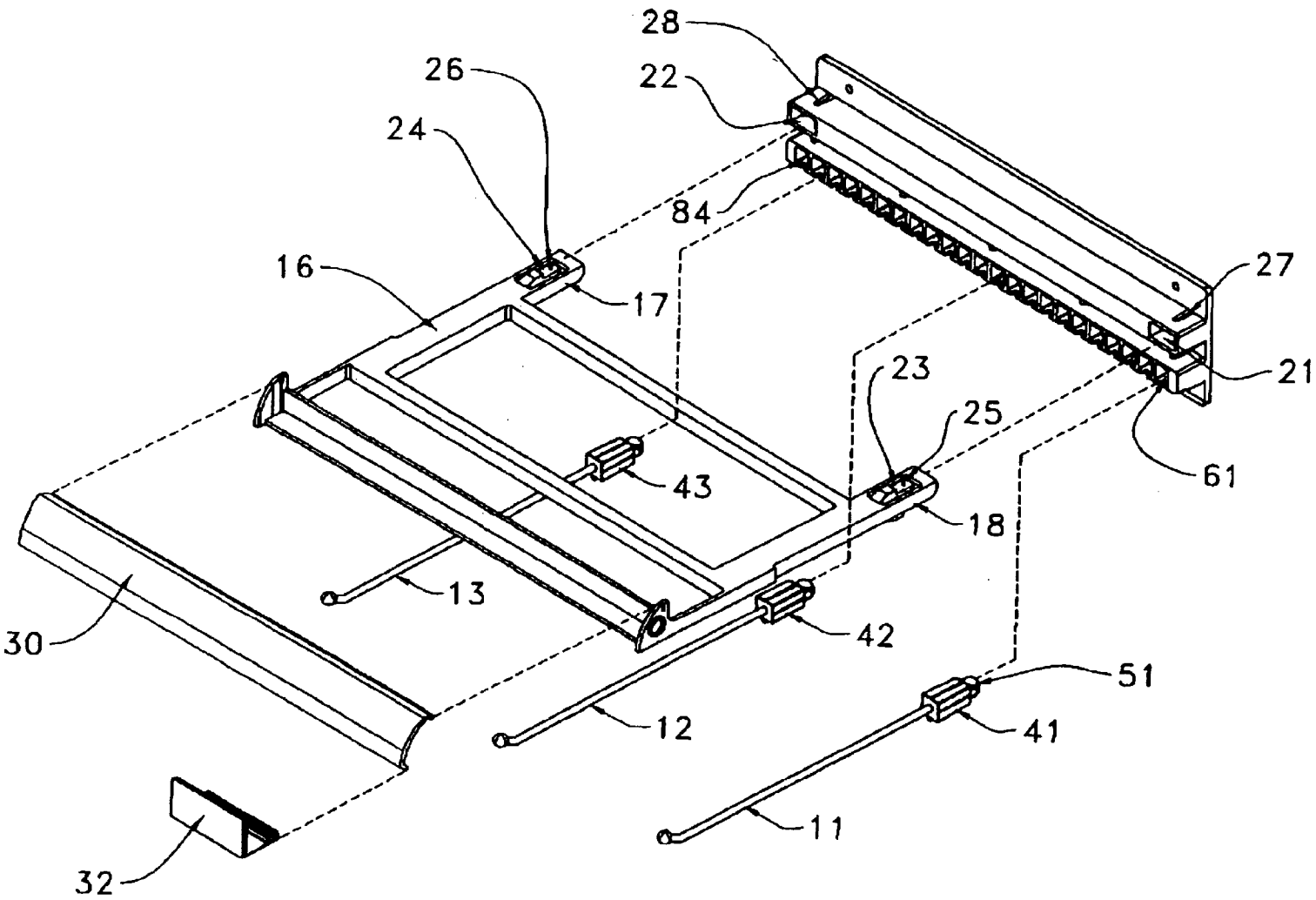
FIG. 2. is a similar view showing the parts exploded for clarity.
Figure 4:
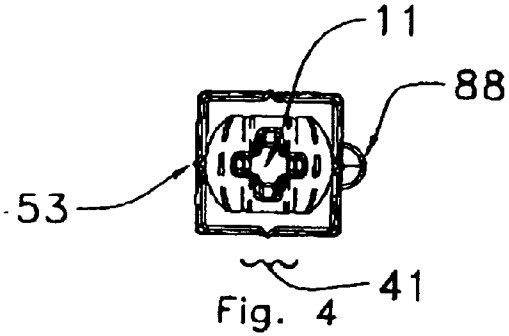
FIG. 4 is a bottom plan view thereof.
Figure 5:
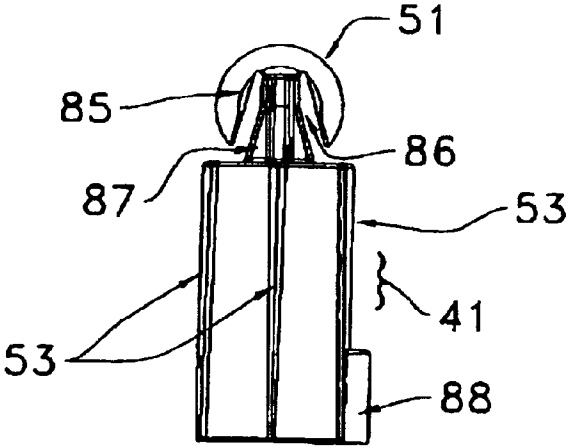
FIG. 5 is a front elevation thereof.
Figure 6:
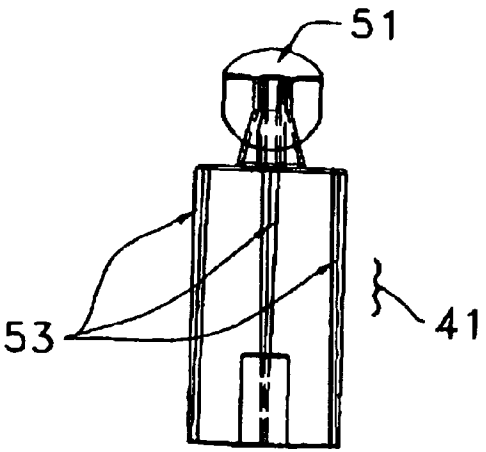
FIG. 6 is a side elevation thereof.
Figure 8D:
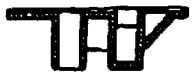
FIG. 8D is a side elevation thereof sectioned through plane D of FIG. 8.
Figure 8C:
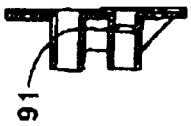
FIG. 8C is a side elevation thereof sectioned through plane C of FIG. 8.

FIG. 4 shows a bottom plan view of this snap showing the go shaft of a hook such as 11 molded into the snaps 41. FIG. 5 shows a front view of snap ball 51 showing how gaps 85 and 86 between ball 51 and pedestal 87 allow snap 51 to compress on insertion into a socket such as 61 (FIG. 2) on back 4 as shown in FIG. 2. Ridge 53 (FIG. 3) provides a slightly deformable friction surface to provide a tight fit between snap 41 and its hook socket.

Orientation tab 88 facilitates proper orientation of the hooks on insertion.

Figure 7:
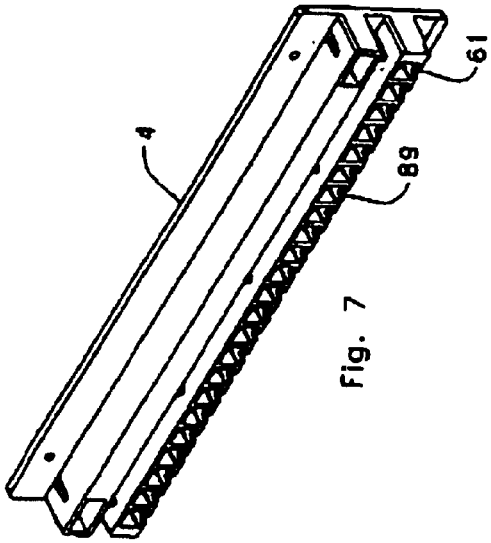
FIG. 7 is a three-dimensional orthogonal view of the mounting back of the present invention.
Figure 8E:
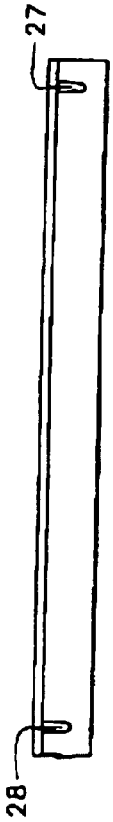
FIG. 8E is a top plan view thereof.
Figure 8:
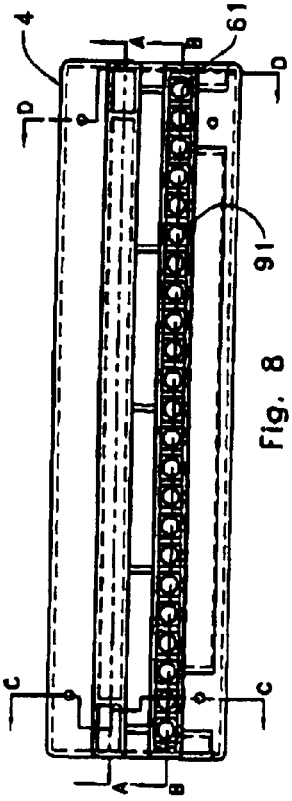
FIG. 8 is a front elevation thereof.
Figure 8A:
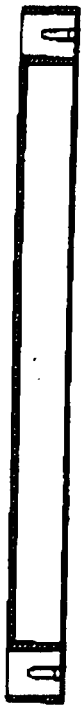
FIG. 8A is a bottom plan view, taken in section through plane A of FIG. 8.
Figure 8B:
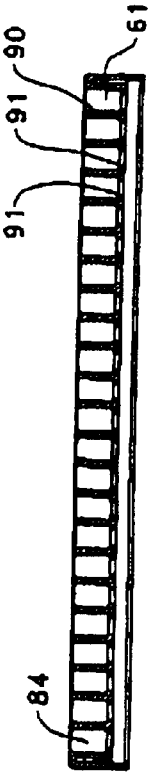
FIG. 8B is a bottom plan taken in section through the plane B of FIG. 8.
Figure 8F:
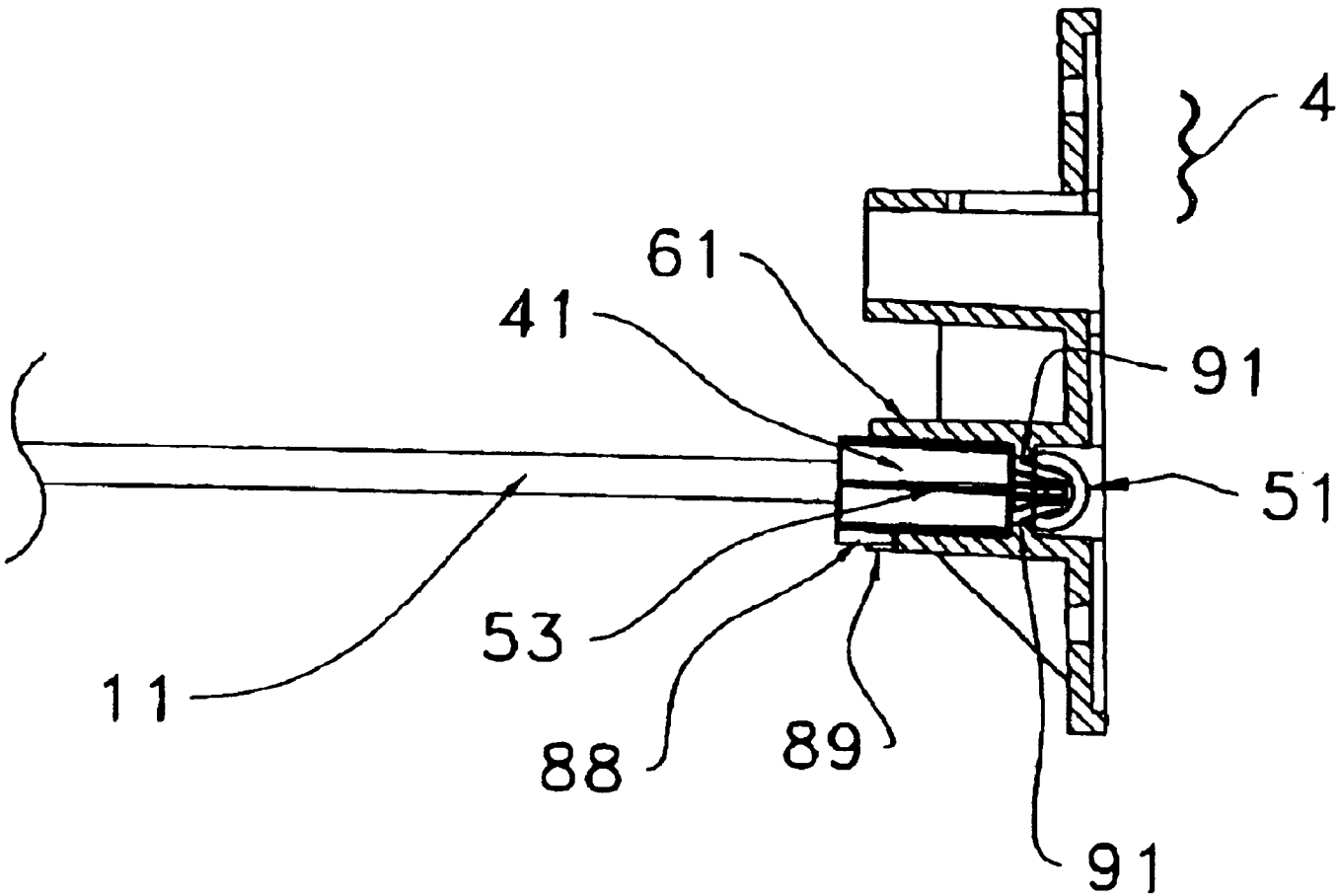
FIG. 8F is a side elevation in section similar to FIG. 8C but with a hook in place.

FIG. 8F shows how the hook's snap 41 fits into a socket such as 61. In order to achieve a proper fit, tab 88, shown also in FIG. 3 must be oriented downward to properly fit into slot 89 shown also in FIGS. 7 and 9. Ridges 53 provide a snug friction fit and, since they are slightly flexible, deform slightly to apply pressure to the side walls 90 of socket 61. Ball 51 deforms slightly as it passes past ridge 91 which forms a circular collar, and then the ball head springs out and passes the collar to effect a snap fitting with the socket. A positive a click is heard and now a larger amount of force will be required to remove the ball 51 and the snap mount 41 from the socket 61.

Figure 9:
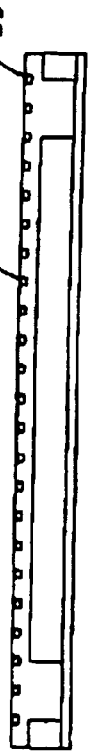
FIG. 9 is a bottom plan view thereof.

FIGS. 7, 8 and 9 provide more detail of back 4 showing the shapes of the socket 61–84. FIGS. 8A, 8B and 9 are bottom plan views 8A and 8B being in section. FIG. 8E is a top plan view.

Figure 12C:
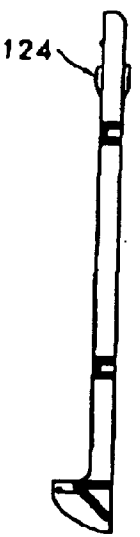
FIG. 12C is a side elevation sectioned through plane C (the centerline) of FIG. 12.
Figure 12B:
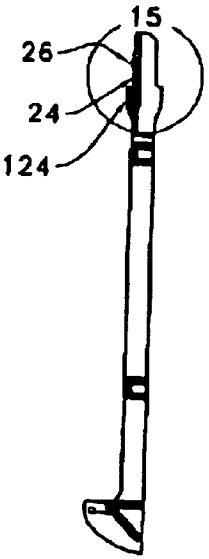
FIG. 12B is a side elevation sectioned through plane B of FIG. 12.
Figure 13:
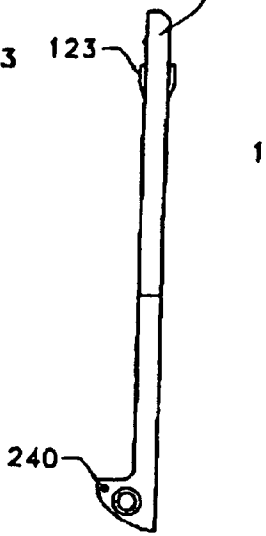
FIG. 13 is a side elevation of said frame.
Figure 12:
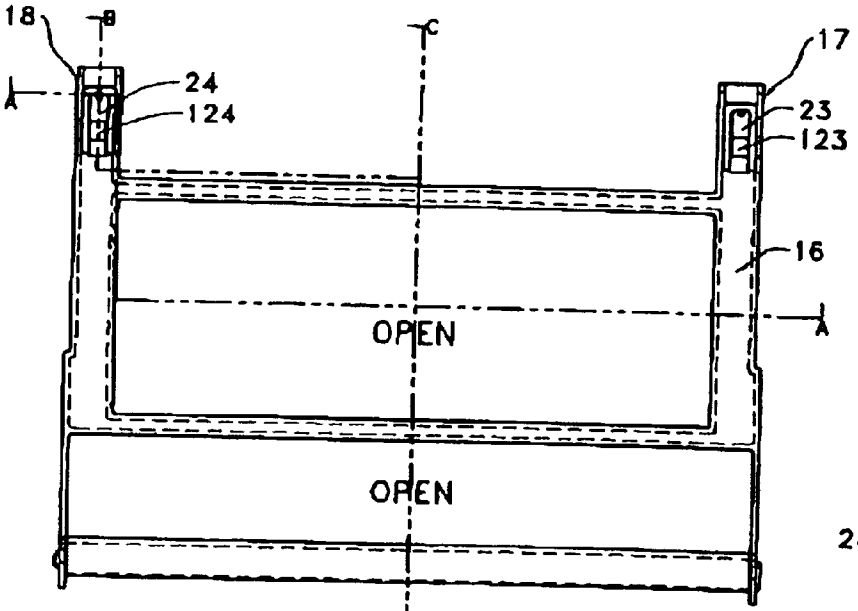
FIG. 12 is a plan view of the bullnose header frame.
Figure 15:
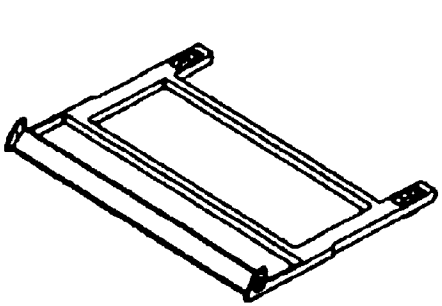
FIG. 15 is a detail of the area circled in FIG. 12B.
Figure 15:
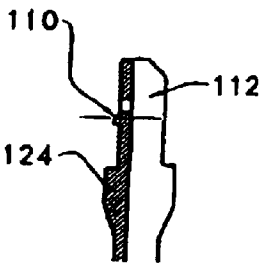
Figure 14:
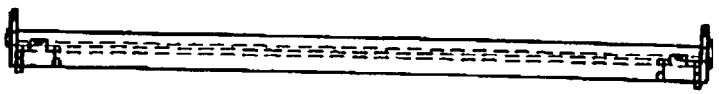
FIG. 14 is a rear elevation of said frame.
Figure 12A:
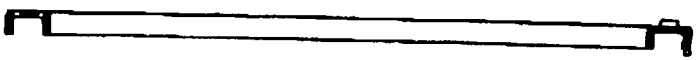
FIG. 12A is a back elevation sectioned through plane A of FIG. 12.

Slots 27, 28 in FIG. 8E are for receiving pins 25–26 atop tabs 23-4 as on bayonet plug 117 shown in FIGS. 12B and 15. When the plug-in module 16, shown in FIG. 12, is inserted by its plugs 18 and 17 into sockets 21 and 22, tabs 23-4 bias pins 25–26 into slots 27 and 28 so that the bullnose frame 16 bayonet-clips into place on back 4. To release module 16 from Back 4, press release buttons 123–124 to depress tabs 23–24 and thereby lower and disengage pins 110 from slots 27–28. Fogs, 12–14.

Figures 10, 11, 11A, 11B, 11C, 11D:
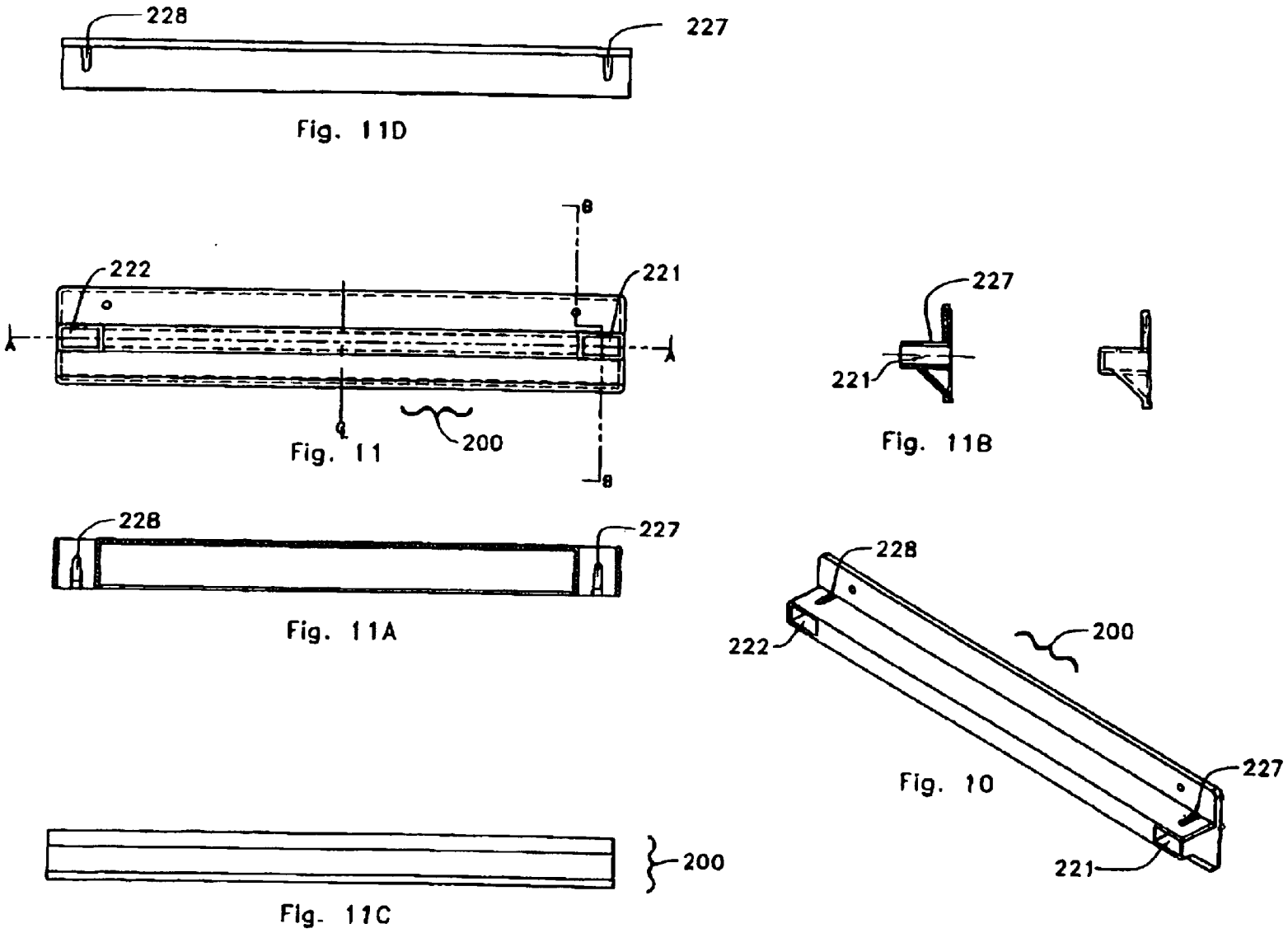
FIG. 10 is a three-dimensional orthogonal view of a separate header bar for mounting the bull nose frame.
FIG. 11 is a front elevation thereof.
FIG. 11A is a bottom plan view taken in section through plane A of FIG. 11.
FIG. 11B is a side elevation sectioned through plane B of FIG. 11
FIG. 11C is a bottom plan view thereof.
FIG. 11D is a top plan view thereof.

FIG. 10 is a three dimensional view of a different embodiment of a back panel 200. This accepts the bullnose header frame without providing sockets for the extended hooks which were shown in FIGS. 1 and 2. This header might be placed over a conventional peg board or any other hook or shelf set up where an extended header frame is useful. FIG. 10 shows back panel 200. FIG. 11 is a front view thereof. Sockets 221 and 222 are similar to sockets 21 and 22 in FIGS. 1 and 2. FIG. 11A, sectioned from below through plane A of FIG. 11, shows the pin receiving slots 227–228, which are shown in the top view of FIG. 11D. FIG. 11B is taken in section through socket 221. FIG. 11C is the bottom plan view thereof.

Figure 19:
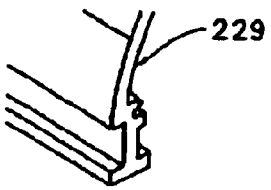
FIG. 19 is a detail of area 19 in FIG. 16.
Figure 17A:
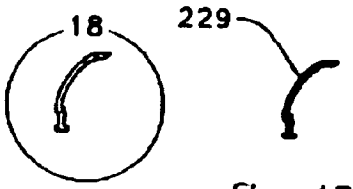
FIG. 17A is a side elevation in section through plane A of FIG. 17.
Figure 16:
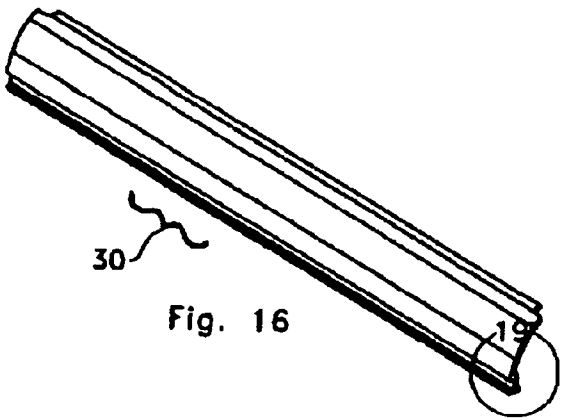
FIG. 16 is a three-dimensional orthogonal view of a bullnose clear cover surface designed for sales information display.
Figure 17:
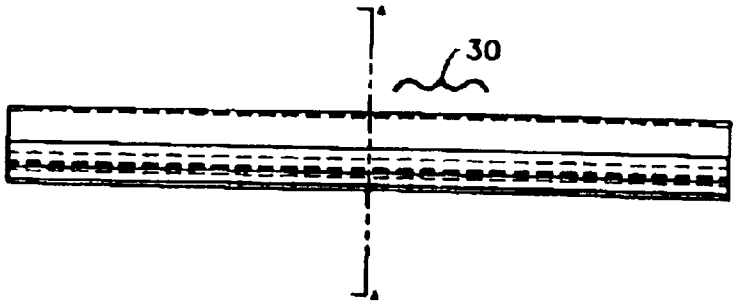
FIG. 17 is a front elevation of said bullnose cover.
Figure 18:
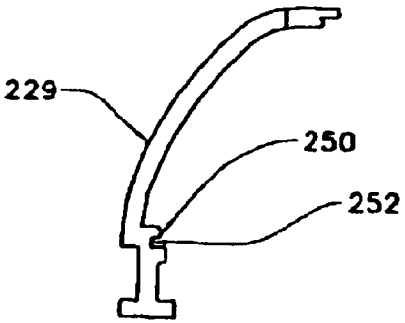
FIG. 18 is a side elevation thereof.
Figure 20:
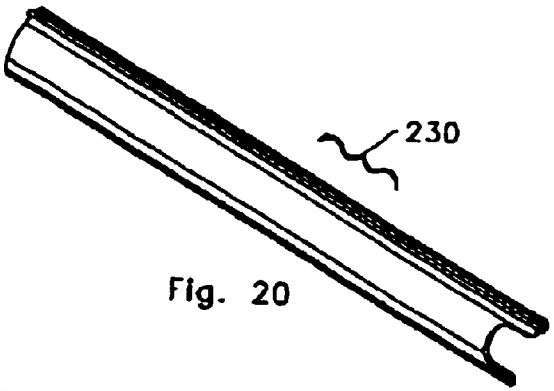
FIG. 20 is a three-dimensional orthogonal view of the cover's back.
Figure 21A:
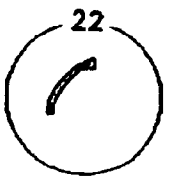
FIG. 21A is a side elevation sectioned through plane A of FIG. 21.
Figure 21A:
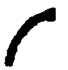
Figure 21:
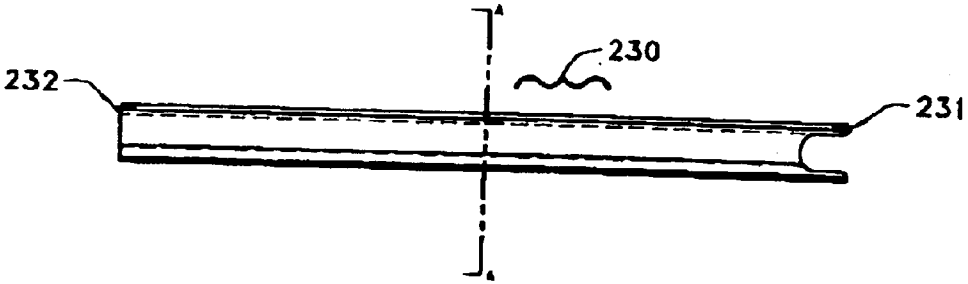
FIG. 21 is a front elevation thereof.
Figure 22:
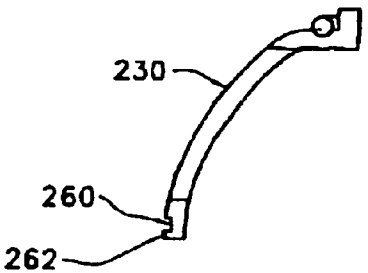
FIG. 22 is a side elevation thereof.

FIGS. 16–19 show the bullnose clear cover 30 which comprises a front cover portion 229 detailed in FIGS. 17 through 19, which mates to a back cover 230 detailed in FIGS. 20–22. Back cover 230 snaps behind front cover 229 and pins 231, 232 protrude from the ends of the back cover 230. These pins snap into holes such as 240 shown in FIG. 12C on the bullnose frame. Header information on card stock can then be slipped between the front 229 and back covers 230 that form bullnose 30. Ridge 250 and groove 252 (FIG. 18) snap into groove 260 and Ridge (FIG. 22) to mate front 229 to back 230 to form bullnose 30.

It can be seen that the aforementioned system provides a flexible configuration for various displays in a more attractive, easily cleaned, easily maintained hook display system.

We claim:

1. A display system, for displaying products, said display system including:

a back;

a plurality of hook sockets on said back;

a plurality of plug-in display hooks, each hook maintainable to any socket of the plurality, said hooks for hanging the products of various product widths by spacing the hooking as the product widths require, among the sockets;

each said hook having a front end distal from the sockets said back having a header socket;

a header module adapted to plug into the header socket;

said plug-in header module having a display window for product descriptions and pricing; and said plug-in header module extending frontward to the front ends of the hooks, for displaying the display window, visually unobstructed by the products;

the hook snap has a ball, and said ball snap into one of the a hook sockets which are cooperatively designed to receive said hook snaps;

the hook snap also has a pedestal;

there is a gap between the ball and the pedestal;

the socket has within a compression member, for squeezing the ball as the ball is inserted into the socket, which ball thereafter snaps open, locating the gap at the compression member, and thereby holding the hook snap securely in the hook socket, with the pedestal providing firm contact with inner walls to the hook socket thereby strongly supporting the hook.

2. A display system, according to claim 1, in which:

a ridge provides a slightly deformable friction surface to provide a tight fit between the hook snap pedestal snap and the inner walls of the hook socket.

3. A display system, according to claim 2, in which:

an orientation tab on the pedestal cooperates with a correspondingly shaped slot on one of the inner walls to facilitate proper orientation of the hooks on insertion.

4. A display system, for displaying products, in which said display products protrude forward to a display plane, said display system including:

a back;

said back having a header socket;

a header module adapted to plug into the header socket;

said plug-in header module having a display window for product descriptions and pricing; and said plug-in header module extending frontward to the display plane, for displaying the display window visually unobstructed by the product;

the header module includes a pair of the plugs which fit into a pair of the header sockets;

snap tabs on the planes are spring biased to snap into the header sockets;

the snap tabs each have a pin;

the header sockets each have slots;

the pins spring up into the slots, which receive the pins and lock the header module in place on the back;

a secondary header protrudes from the header, in which, on the header:

a bullnose clear cover has a front cover portion;

the front cover portion mates to a back cover;

back cover snaps behind the front cover;

two cover pins protrude form the ends of the back cover;

the cover pins snap into two frame holes on a frame of the header;

said covers then define a location into which header information on card stock can then be slipped between the front cover and the back cover.

5. A display system, for displaying products, said display system including:

a back;

a plurality of hook sockets on said back;

a plurality of plug-in display hooks, each hook mountable to any socket of the plurality, said hooks for hanging the products of various product widths by spacing the hooks, as the product widths require, among the sockets;

each said hook having a front end distal from the sockets, said back having a header socket;

a header module adapted to plug into the header socket;

said plug-in header module having a display window for product descriptions and pricing; and said plug-in header module extending frontward on the front ends of the hooks, for displaying the display window, visually unobstructed by the products;

in which, on the header:

a bullnose clear cover has a front cover portion;

the front cover portion mates to the back cover;

back cover snaps behind the front cover;

two cover pins protrude from the end of the back cover;

the cover pins snap into two frame holes on a frame of the header;

said covers then define a location into which header information on card stock can then be slipped between the front cover and the back cover.

* * * * *